United States Patent [19]

Papadakos

[11] 4,246,764

[45] Jan. 27, 1981

[54] WATER AND ENERGY CONSERVATION SYSTEM FOR FOOD SERVING ESTABLISHMENTS

[76] Inventor: Jimis Papadakos, 125 Elm St., Yonkers, N.Y. 10701

[21] Appl. No.: 12,876

[22] Filed: Feb. 16, 1979

[51] Int. Cl.[3] ..... F25B 27/02

[52] U.S. Cl. ..... 62/183; 62/238; 126/374

[58] Field of Search ..... 62/238 E, 324 D, 183; 237/2 B; 236/21 B, 92 C; 126/374

[56] References Cited

U.S. PATENT DOCUMENTS

| | | | |
|---|---|---|---|
| 2,668,420 | 2/1954 | Hammell | 62/238 E |
| 4,098,092 | 7/1978 | Singh | 62/324 D |

*Primary Examiner*—William E. Wayner

*Attorney, Agent, or Firm*—Constantine A. Michalos; Peter C. Michalos

[57] ABSTRACT

A water and energy conserving apparatus for supplying pre-heated water to a hot water heater and for cooling at least one refrigeration unit using a compressible medium in a food serving establishment comprising, a pre-heater tank adapted to receive water from a cold water source and having a cold water inlet line connected to the cold water source and a cold water outlet line. A heat exchanger which is associated with the refrigeration unit is connected to the cold water output line coming from the tank. A hot water output line is connected between the heat exchanger and the tank for returning water from the heat exchanger to the tank. The compressible medium which is hot is supplied from the refrigeration unit to the heat exchanger and the water flowing through the heat exchanger cools the compressible medium thus picking up heat. A circulator is connected into the hot water output line for circulating water from the tank to the heat exchanger and back. A drain line is connected to the heated water output line and includes a normally closed solenoid valve. The drain line is connected to a drain and is provided to vent water from the pre-heater tank. A thermostat is connected to the cold water output line coming from the tank to sense the temperature. The thermostat is connected to a power supply which powers the solenoid and when the temperature of water in the cold water output line rises above a selected value, which is preferably in the vicinity of 85 degrees Fahrenheit, the solenoid valve is energized to open the flow of water in the drain line and vent water from the pre-heater tank. A pre-heater water line is connected between the pre-heater tank and the hot water heater to supply pre-heated water to the hot water heater to conserve energy used in heating the otherwise cold water normally supplied to the hot water heater.

6 Claims, 2 Drawing Figures

WATER AND ENERGY CONSERVATION SYSTEM FOR FOOD SERVING ESTABLISHMENTS

BACKGROUND OF THE INVENTION

1. Field of the Invention

The present invention relates in general to resource conservation apparatus and, in particular to a new and useful water and energy conserving device adapted to be used in food serving establishments where refrigeration units are used and where a large supply of hot water is necessary.

2. Description of the Prior Art

Food serving establishments such as restaurants and diners, require a large and ready supply of hot water for dishwashing, general cleaning, and food preparation purposes. These establishments also require a plurality of refrigeration units for cooling the various refrigeration boxes needed to preserve large quantities of food and for cooling such other devices a beverage dispensing apparatus for carbonating and dispensing soda or for dispensing water.

Heretofor it has been common practice to cool the compressors using cold water drawn from a general water supply connected to the establishment. The same cold water supply is used to supply water to the often large and high capacity hot water heaters used in such establishments. The hot water heaters used in these establishments are supplied with a fuel such as gas, oil, or electricity for heating the hot water in a tank provided in the hot water heater.

It is not uncommon to pay several thousand dollars a month in water and heating bills in a medium size establishment of between 100 to 200 seat capacity. In these establishments usually there is needed approximately 8 tons of refrigeration. Water consumption of such an establishment is on the order of approximately 100 to 200 gallons per hour per ton. That is, a total of 800 to 960 gallons of water is used in one hour. Where the establishment is open for business for a substantial portion of the day, as is the case with diners, there is a tremendous loss of water, and energy in heating the water.

Refrigeration units in such establishments usually include compressors for compressing a compressible medium such as Freon or other gas and, a reservoir or coils into which the compressed medium is permitted to expand for absorbing heat and producing a refrigeration effect. These compressors, when they are not cooled by water, are cooled by the ambient air. Such air cooled compressors are often of low efficiency since they are unable to shed sufficient heat especially when several compressors are working simultaneously to raise the ambient temperature. A loss of such efficiency is accompanied with an increase in the used energy which is usually electricity, for powering the compressors.

Various devices are known for utilizing, conserving and recirculating heat. Examples of such devices can be found in U.S. Pat. No. 2,255,967 to Collins issued Sept. 16, 1941. Other examples are U.S. Pat. No. 2,751,761 to Borgerd issued June 26, 1956; U.S. Pat. No. 3,989,183 to Gustafsson issued Nov. 2, 1976 and U.S. Pat. No. 3,976,123 to Davies issued Aug. 24, 1976. These patents have been cited as relevant in showing prior art structures for utilizing heat.

SUMMARY OF THE INVENTION

The present invention is intended to be used especially in food serving establishments where a large supply of hot water is required and where one or several refrigeration units are operated. The invention has been used, on an experimental basis, in several establishments and has been found to save substantial amounts of water when water is used to cool refrigeration units and, to save a substantial amount of energy in the production of hot water heaters.

Considering the large savings which have been experienced, the apparatus is made of readily available and inexpensive materials which produces a quit favorable capital return when the invention is used in these food serving establishments.

The invention provides a pre-heater tank for receiving cold water from a cold water supply. The cold water supplied to the pre-heater tank is, itself supplied to a heat exchanger which is associated with a refrigeration unit.

The heat exchanger is advantageously of a double tube construction with one tube being supplied with the compressible medium from the compressor and the other tube being supplied with cold water from the pre-heater tank. A circulator is connected into the line leading from the heat exchanger and draining back into the pre-heater tank for circulating water between the pre-heater tank and the heat exchanger. Water circulated to the heat exchanger picks up residual heat from the compressor and thereby the heat exchanger picks up residual heat from the compressor and thereby improves the efficiency of the compressor and the refrigeration unit. Now heated water in the pre-heater tank is supplied to the imput fitting of a hot water heater and the water is thereafter raised further by the fuel supplied to the hot water which can be gas, electricity, or oil. Since the water to be heated is raised from a pre-heated temperature to its eventual hot water state, substantial savings are realized since the fuel is conserved, which normally would raise the cold water coming from the cold water supply to the temperature of the pre-heated water.

It has been found that the device works most advantageously when the water in the storage or pre-heater tank is at a temperature of between 55 degrees to 80 degrees Fahrenheit. A danger arises when the water rises above 85 degrees Fahrenheit. To accommodate this danger, a drain line is connected into the return lines supplying from the heat exchanger to the storage tank. A normally closed solenoid valve is connected into the drain line and is itself connected to a power supply, which power supply is connected to a thermostat. The thermostat is connected to the cold water output line coming from the storage tank and going to the heat exchanger for sensing the temperature of water therein. When the water in the cold water output line rises above 85 degrees Fahrenheit or thereabout, the thermostat energizes the power supply switch, in turn, energizes the solenoid, opening the valve and releasing water from the heated water return line. The water is then supplied to a drain for venting the system and removing any possible danger of bursting the storage tank or other elements.

Accordingly, an object of the present invention is to provide a water and energy conserving apparatus for supplying pre-heated water to a hot water heater and for cooling at least one refrigeration unit using a compressible medium in a food serving establishment comprising, a pre-heater tank adapted to be connected to a source of cold water for receiving cold water therefrom, a cold water input line connected to said tank and adapted to be connected to the source of cold water to supply cold water to said tank, a cold water output line connected to said tank, a heat exchanger connected to said cold water output line for receiving the compressible medium from the refrigeration unit and cooling the medium and for receiving cold water through said cold water output line, a heated water output line connected to said heat exchanger and to said tank for supplying water heated by the medium in said heat exchanger to said tank, a circulator connected to at least one of said cold water output line and said heated water output line for circulating water between said tank and said heat exchanger, a drain line connected to at least one of said cold water output line and said heated water output line for draining water therefrom, valve means in said drain line for normally blocking the flow of water in said drain line, thermostat means connected to said cold water output line for sensing the temperature of water therein, said thermostat means connected to said valve means for energizing said valve means and opening a flow of water in said drain line when the temperature of water in said cold water output line arises above a selected temperature, and a pre-heated water line connected between said tank and the water heater for supplying pre-heated water to the water heater.

Another object of the present invention is to provide an apparatus for conserving water and energy which is simple in design, rugged in construction and economical to manufacture.

The various features of novelty which characterize the present invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
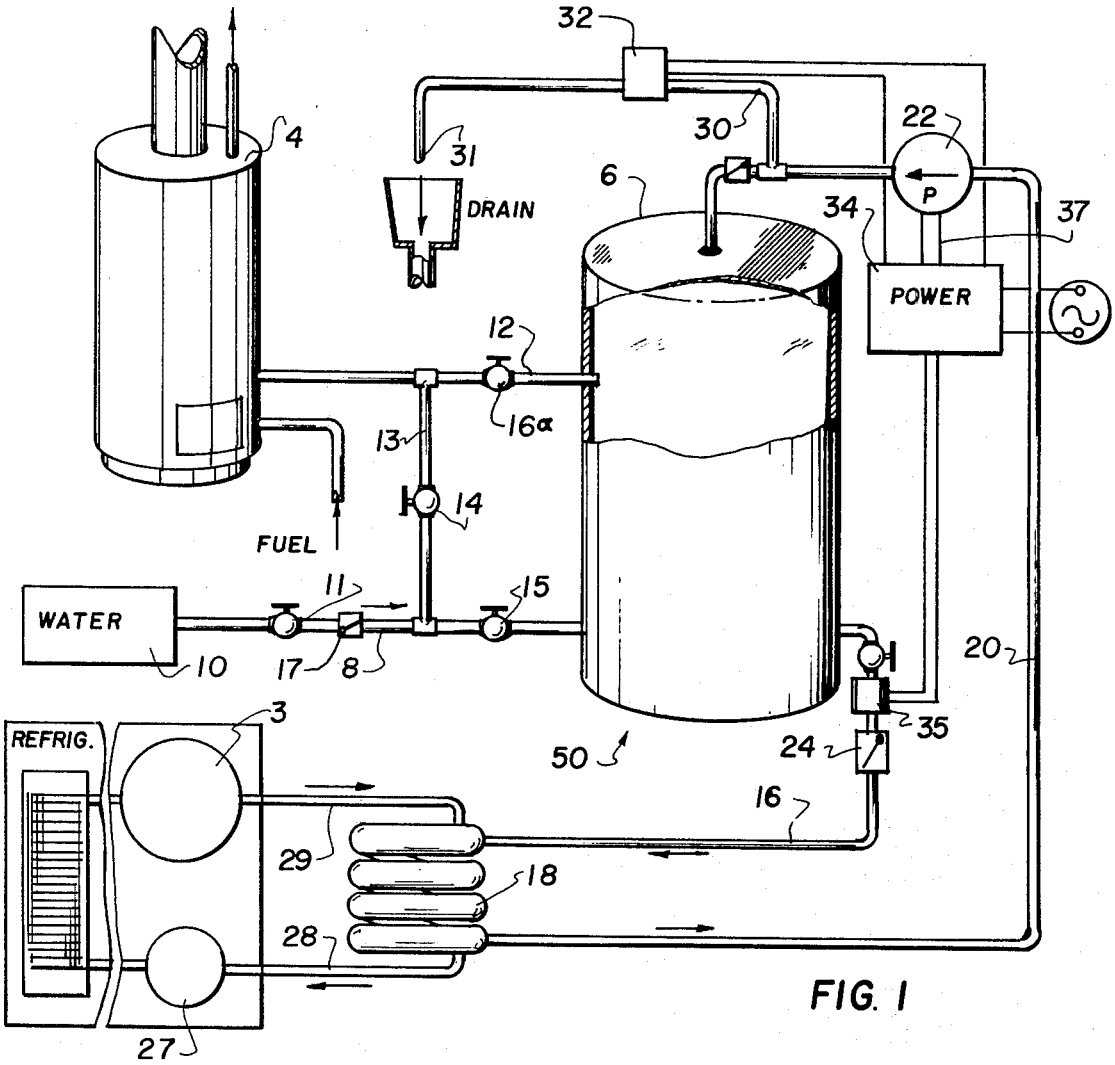
FIG. 1 is a schematic diagram of the overall system as it is connected to the compressors and hot water heater of a food serving establishment, according to the invention; and, FIG. 2 is a detailed view of one embodiment of the heat exchanger.

Referring to the drawings in particular, the invention embodied therein comprises, an apparatus generally designated 50 for conserving water supplied to a compressor 3 for cooling the compressible medium thereof where the compressor is used as a refrigeration unit. The device also conserves energy supplied to a hot water heater 4.

The apparatus comprises a pre-heater or storage tank 6 which is connected by a cold water input line 8 to a ready source of water 10 such as a city or county main. Cold water supply 8 can be provided with a shut off valve 11 for closing the flow of water to the apparatus. The hot water heater 4 is supplied with water through a pre-heated water line 12. Bypass line 13 is connected directly between the cold water supply line 8 and the pre-heated water line 12 and includes a valve 14 which can be opened to bypass the apparatus of this invention when necessary. Further, shut off valves 15 and 16 are provided in the water lines 8 and 12 to close the water flow. This seperates the apparatus of the invention completely and permits the total flow of water to pass through bypass line 13. In this manner, the inventive apparatus can be repaired without interupting the overall circulation of the system.

In addition, the system is provided with check valve 17 to prevent any water from returning to the city water line if the outside city valve (not shown) is temporarily malfunctioned.

Cold water supply line 8 and pre-heated water line 12 are connected into the storage tank 6. Water from the storage tank 6 can be supplied to the hot water heater 4 through line 12 by normal flow.

Cold water output line 16 is connected between the storage tank 6 and one end of a heated exchanger 18 which may be of a double tube construction to be described with reference to FIG. 2 An opposite end of heat exchanger 18 is connected to heated water line 20 which, in turn, is connected to tank 6 and supplies water thereto.

A pump or circulator 22 is connected into the line 20 for circulating water between the tank 6 and the heat exchanger 18. Pump 22 may be connected into the line 16, however, if it is desired, Line 16 is supplied with a check valve 24 for insuring the flow of water as shown in FIG. 1. Preferably cold water output line 16 is connected near the bottom of tank 6 to receive the cooler water therefrom and heated water line 20 is connected near the top of tank 6 to supply hot water to the top thereof. Pre-heated water line 12 is also advantageously connected near the top of tank 6.

Compressor or refrigeration unit 3 which is of conventional design, includes a reservoir 27 and lines 28, 29 for permitting the circulation of a compressible medium such as Freon or another gas. Lines 28 and 29 are connected to opposite ends of heat exchanger 18 and are connected in such a way to be isolated from the flow of water between lines 16 and 20 and through heat exchanger 18. Water thus supplied by line 16 and entering heat exchanger 18 picks up heat produced by compressor 3 and thus the water leaves as heated water in line 20.

To prevent an overheating of water in storage tank 6, a drain line 30 is provided which is connected to a drain 31 for venting water from the system when necessary. A solenoid valve 32 is connected into line 30 and is normally closed. A power supply 34 is connected to the solenoid valve 32 and may be energized to open the valve thus removing water from the system through drain line 30. Although drain line 30 is shown connected to the line 20, it can equally be connected to line 16 to vent water from this portion of the system. Power supply 34 with solenoid valve 32 comprise a valve means for the drain line 30.

A thermostat 35 is connected to the output line 16 for sensing the temperature of water therein. When the temperature of water in line 16 rises above a selected temperature such as for example, 85 degrees Fahrenheit, the thermostat 35 energizes power supply 34, and causes solenoid valve 32 to open and release water through drain line 30. A line 37 is shown connected between the circulator or pump 22 and the power supply 34 and this line is utilized to deactivate circulator pump 22 when the thermostat 35 energizes solenoid 32.

Thus, the water is drained through pipe 30 only at a time when circulator 22 is not working to prevent an unnecessarily high loss of water into the drain 31.

Figure 2:
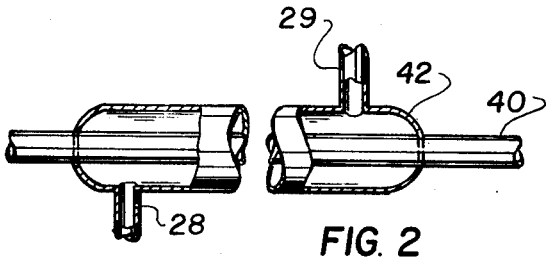

Turning to FIG. 2, a heat exchanger is shown which advantageously comprises an inner tube 40 advantageously made of copper and an outer tube 42 which acts as a jacket. Lines 28 and 29, for the compressible medium coming from compressor 3, is supplied to opposite ends of the jacket or outer tube 42 and water is supplied through the inner tube 40 from line 16 to line 20. This arrangement is coiled a plurality of times to increase the thermal coupling between the water in tube 40 and the medium in tube 42 that is of conventional and commercially available design.

As an additional safety, in the event of the failure of pump 22, a flow valve switch (not shown) may be provided in line 16 to energize solenoid 32 to open the drain 31 and thus bypass the system to permit circulation of the water.

While specific embodiments of the invention have been shown and described in detail to illustrate the application of the principles of the invention, it will be understood that the invention may be embodied otherwise without departing from the principles.

I claim:

1. A water and energy conserving apparatus for supplying pre-heated water to a hot water heater and for cooling at least one refrigeration unit using a compressible medium in a food serving establishment comprising:

a pre-heater tank adapted to be connected to a supply of cold water for receiving cold water therefrom;

a cold water input line connected to said pre-heater tank and adapted to be connected to the source of cold water to supply cold water to said pre-heater tank;

a cold water output line connected to said pre-heater tank;

a heat exchanger connected to said cold water output line for receiving the compressible medium from the refrigeration unit and cooling the medium;

a heated water output line connected to said heat exchanger and to said pre-heater tank for supplying water heated by the compressible medium in said heat exchanger to said pre-heater tank;

circulator means connected to at least one of said cold water output line and said heated water output line for circulating water between said pre-heater tank and said heat exchange;

a drain line connected to at least one of said cold water output line and said heated water output line for venting water to a drain;

valve means connected to said drain line for normally closing the flow of water therein;

thermostat means connected to said cold water output line for sensing the temperature of water therein;

said thermostat means connected to said valve means for opening said valve means and permitting a flow of water in said drain line when the temperature of water in said cold water output line rises above a selected temperature; and, a pre-heated water line connected between said pre-heater tank and the hot water heater for supplyin pre-heated water to the hot water heater.

2. An apparatus according to claim 1 wherein said valve means comprises a power supply connected to said thermostat means and a normally closed solenoid valve connected to said power supply.

3. An apparatus according to claim 1 wherein said circulator means comprises a circulator pump and is in said heated water output line.

4. An apparatus according to claim 1 wherein said heat exchanger comprises a double tube structure having an inner tube connected between said cold water output line and said heated water output line and an outer tube connected to a flow of the compressible medium in said refrigeration unit.

5. An apparatus according to claim 1 further including a check valve in said cold water output line for insuring a flow of water from said cold water output line to said heat exchanger and thereafter through said heated water output line to said pre-heater tank.

6. An apparatus according to claim 1 further including a bypass line connected between said cold water input line and said pre-heated water line, a valve in said bypass line and a valve in said cold water input line, said valve in said bypass line being openable and said valve in said cold water input line being closable to stop the flow of water to said apparatus and direct water directly from the cold water supply to the hot water heater.

* * * * *